US012207676B2

(12) United States Patent
Kirk et al.

(10) Patent No.: US 12,207,676 B2
(45) Date of Patent: Jan. 28, 2025

(54) CIGARETTE ROLLING MACHINE

(71) Applicant: GRASSHOPPER ROLLERS, LLC, Clinton Township, MI (US)

(72) Inventors: Catherine Kirk, Clinton Township, MI (US); Stavros Toma, Clinton Township, MI (US); Michael Sulkowski, Commerce, MI (US)

(73) Assignee: Grasshopper Rollers, LLC, Clinton Township, MI (US)

( * ) Notice: Subject to any disclaimer, the term of this patent is extended or adjusted under 35 U.S.C. 154(b) by 216 days.

(21) Appl. No.: 17/134,680

(22) Filed: Dec. 28, 2020

(65) Prior Publication Data

US 2022/0202067 A1 Jun. 30, 2022

(51) Int. Cl.

| | |
|---|---|
| ***A24C 5/44*** | (2006.01) |
| ***A24C 5/10*** | (2006.01) |
| ***A24C 5/39*** | (2006.01) |

(52) U.S. Cl.

CPC ..... *A24C 5/44* (2013.01); *A24C 5/10* (2013.01); *A24C 5/399* (2013.01)

(58) Field of Classification Search

CPC ..... A24C 5/10; A24C 5/399; A24C 5/44
See application file for complete search history.

(56) References Cited

U.S. PATENT DOCUMENTS

| | | | | | |
|---|---|---|---|---|---|
| 26,382 | A * | 12/1859 | Thorpe | A24C 5/18 | 428/332 |
| 128,133 | A * | 6/1872 | Erfurth | A24C 5/44 | 131/49 |
| 139,375 | A * | 5/1873 | DeForest | A24C 5/44 | 131/47 |
| 536,630 | A * | 4/1895 | Jerstrum | A24C 5/44 | 131/51 |
| 699,607 | A * | 5/1902 | Winget | A24C 1/10 | 131/46 |
| 1,505,126 | A * | 8/1924 | Atkinson | A24C 5/44 | 131/51 |
| 1,891,094 | A * | 12/1932 | Killman | A24C 5/44 | 131/47 |
| 1,956,838 | A * | 5/1934 | Steuart | A24C 5/44 | 131/47 |
| 1,969,586 | A | 8/1934 | Straus | | |
| 1,982,365 | A * | 11/1934 | Ash | A24C 5/44 | 131/49 |
| 2,100,397 | A | 11/1937 | Hollander | | |

(Continued)

*Primary Examiner* — Russell E Sparks
(74) *Attorney, Agent, or Firm* — Brooks Kushman P.C.

(57) ABSTRACT

A cigarette rolling machine formed of a frame pivotably supporting a drum for rotation about a drum axis. The drum circumference forms hopper channel and a spaced apart removal channel parallel to the axis. A forming roller is pivotably mounted adjacent to and spaced from the surface of the drum. An idler roller is also pivotably supported on the frame for rotation parallel to the drum axis. An elongate belt forms a loop extending about the forming and idler roller. The belt has two ends attached to spaced apart sides of the removal channel. A tensioner roller is pivotably supported for rotation parallel to the drum axis. A belt tension adjuster cooperates with the tensioner roller and the frame to releasably affix the axis of the tensioner roller at a plurality of positions relative to the belt in order to vary the diameter of a cigarette to be formed.

18 Claims, 5 Drawing Sheets

(56) References Cited

U.S. PATENT DOCUMENTS

| | | | | | |
|---|---|---|---|---|---|
| 2,572,193 | A | | 10/1951 | Phillips | |
| 2,809,640 | A | * | 10/1957 | Oldenkamp | A24C 5/471 131/94 |
| 11,197,495 | B1 | * | 12/2021 | Bohl, Sr. | A24C 5/46 |

* cited by examiner

CIGARETTE ROLLING MACHINE

TECHNICAL FIELD

This application relates to cigarette rolling machines and a method of rolling a using a cigarette using a cigarette rolling machine.

BACKGROUND

While tobacco has been smoked for thousands of years, the cigarette first introduced to the market in hand rolled form by Philip Morris in 1847. The cigarette making machine was introduced in the 1880s, however many people continued to hand roll cigarettes. Handheld cigarette making machines of various designs appeared on the market in the early 1900s. The sale of handheld cigarette machines remains strong to this day in the DYI market. In spite of over 100 years of development the remains a need to small handheld cigarette machine which is easy to use and can make cigarettes of different diameters with minimal handling of the tobacco during the rolling operation.

SUMMARY

An embodiment of the present cigarette rolling machine is formed of a frame supporting an elongate drum horizontally pivotably supported between the side walls of the frame for rotation about a drum axis. The drum circumference forms hopper channel and a circumferentially spaced apart removal channel parallel to the axis. A forming roller pivotably supported between the frame side walls for rotation about a forming roller axis parallel to the drum axis. The forming roller having a cylindrical surface adjacent to and spaced from the surface of the drum, An idler roller is also pivotably supported between the side walls of the frame for rotation about an idler roller axis parallel to the drum axis. An elongate belt having a width sized to fit between and substantially fill the space between the side walls and a length forms a loop extending about the forming and idler roller. The belt has two ends attached to spaced apart sides of the removal channel in the drum. A tensioner roller is horizontally pivotably supported between the side walls for rotation about a tensioner axis parallel to the drum axis. A belt tension adjuster cooperates with the tensioner roller and the frame to move and releasably affix the axis of the tensioner roller at a plurality of positions relative to the belt in order to vary the diameter of a cigarette to be formed.

In the disclosed embodiment the tension adjuster comprises an eccentrically mounted shaft extending through the tensioner roller and releasably affixable to the side walls at discrete locations to vary the position of the tensioner roller axis.

In the disclosed embodiment a knob is connected to the drum and is pivotable supported on one of the frame side walls. Preferably the knob is provided with an ergonomic feature aligned with the hopper channel to provide drum location information to the user of the device.

The removal channel preferably has at least three mounting points for the ends of the belt so that at least one attachment point can be moved to vary the range of to vary the diameters of a cigarette to be formed when the belt tension adjuster is moved. The belt loop surrounds the forming roller, the idler roller, the tensioner roller and a substantial portion of the circumference of the drum. The surface of the drum between the hopper channel and a circumferentially spaced apart removal channel which is adjacent the forming roller has a sustainably constant radius extends over 90 degrees but less 130 degrees than about the drum circumference.

The surface of the drum between the hopper channel and a circumferentially spaced apart removal channel which is not adjacent the forming roller also has a sustainably constant radius tensioning surface which engages the belt and to maintain belt tension while the cigarette is being formed. This tensioning surface also extends over 90 degrees but less 130 degrees than about the drum circumference.

DETAILED DESCRIPTION

Figure 1:
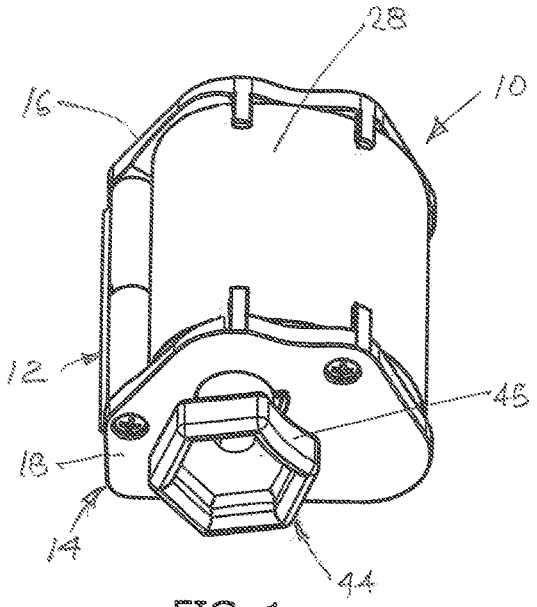
FIG. 1 is a perspective view of an embodiment of the cigarette rolling machine.
Figure 2:
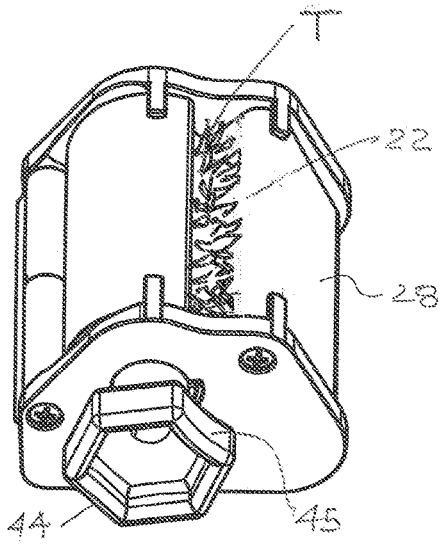
FIG. 2 is a perspective view of the cigarette rolling machine of FIG. 1 with the drum hopper channel being loaded with tobacco.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A preferred embodiment of the cigarette rolling machine 10 is shown if FIGS. 1-9. Preferably the cigarette rolling machine is a small compact structure which can placed on a flat surface and operated by hand. The machine has a frame 12 having a bottom 14 adapted to rest on a generally flat surface with a pair of horizontally spaced apart upright side walls 16 and 18. An elongate drum 20 is horizontally pivotably supported between the side walls 16 and 18 for rotation about a drum axis, The drum has hopper channel 22 and a circumferentially spaced apart removal channel 24 each formed in a surface 26 of the drum parallel to the axis. An elongate belt 28 having a width sized to fit between and substantially fill the space between the side walls 16 and 18. As best shown in the cutaway view in FIG. 3 the belt 28 has a length forming a loop extending about the drum 20, forming roller 30, tension roller 32, and idler roller 34. The belt 28 has two ends 36 and 38 attached to spaced apart sides 40, 42 of the removal channel 24. The forming roller 30 and the idler roller 34 preferably have a sponge layer on its outer periphery providing radial elasticity which helps maintain consistent belt tension during rolling.

Figure 3:
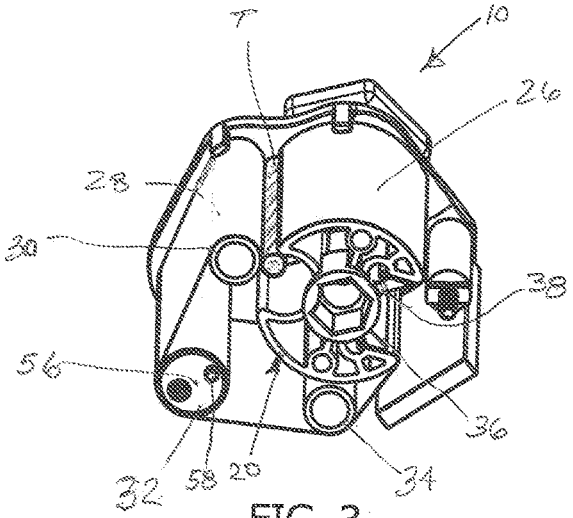
FIG. 3 is a cutaway view of the tobacco roll being initially formed.

In FIG. 1 the drum 20 is oriented in the start position. The drum is provided with a handle in the form of a knob 44 located on the outside of side wall 16. Preferably knob 44 is provided with an ergonomic feature, such as recess 45 aligned with the hopper channel 22 to provide drum location information to the user. When the drum 20 is in the start position shown in FIG. 2, the user can place loose tobacco T or another cigarette material to be rolled on the in belt 28 which is pushed into the hopper channel 22 as shown. Once the correct amount of tobacco for the size of cigarette to be rolled is uniformly placed in channel the knob 44 can be turned counterclockwise, in the embodiment illustrated, to begin forming the loose tobacco into a roll 46 as shown in FIG. 3. The roll 46 is formed by the belt 28 as it forms a loop as the belt wraps around the drum surface 26 and forming roller 30.

Figure 4:
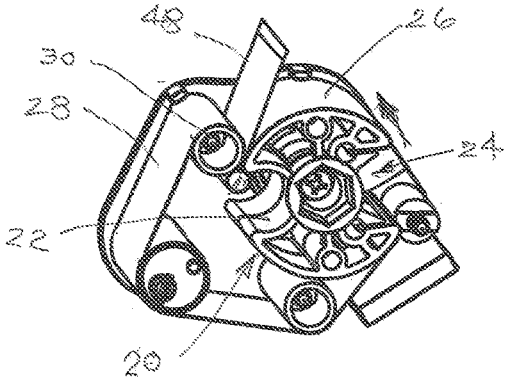
FIG. 4 is a cutaway view of the tobacco roll being formed as the drum rotates and the cigarette paper is introduced.
Figure 5:
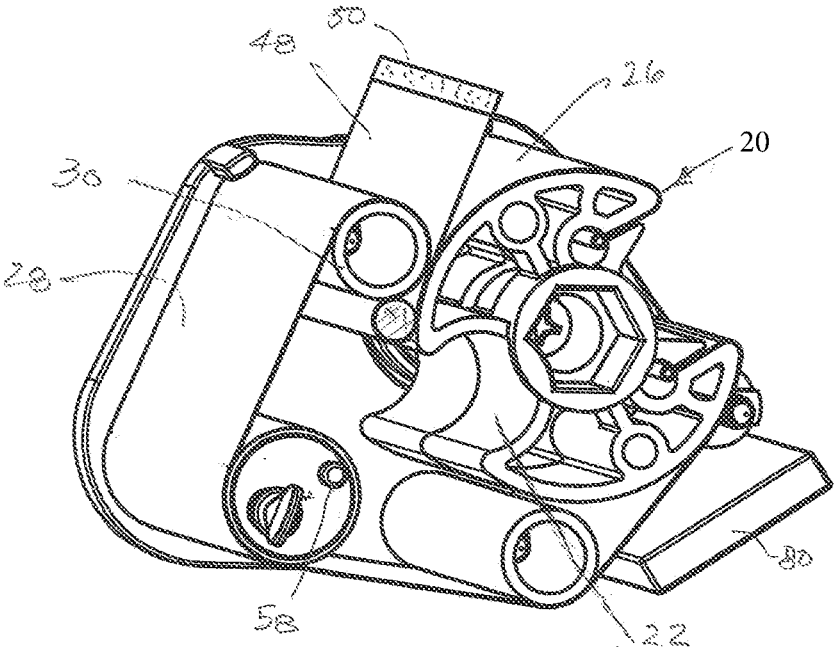
FIG. 5 is a cutaway view of the tobacco roll being formed as the drum rotates and the cigarette paper is being wrapped about the tobacco roll.
Figure 6:
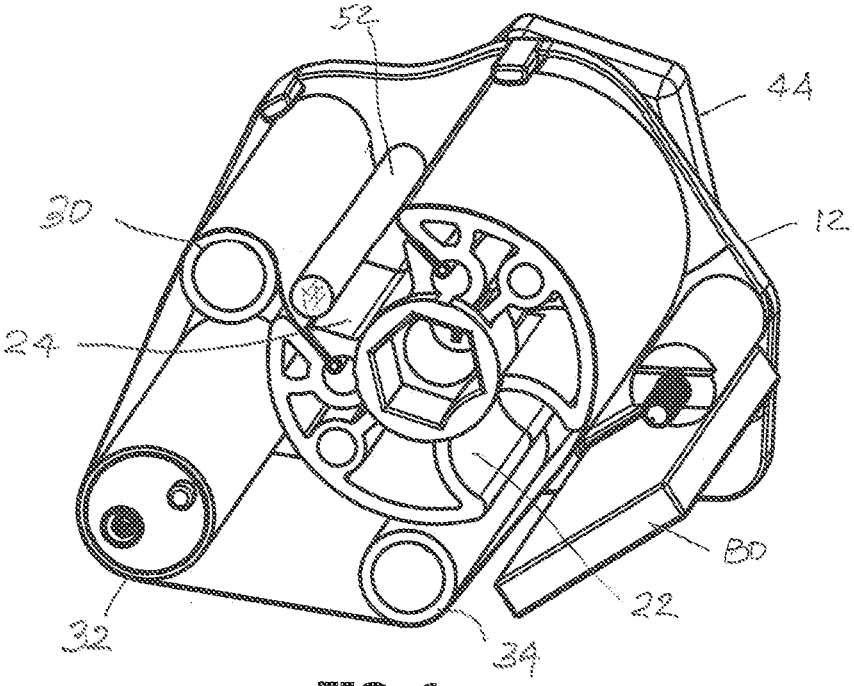
FIG. 6 is a cutaway view showing the completed cigarette in the drum removal channel.

Once the drum surface 26 reached the forming roller 30, as shown in FIG. 4, a cigarette paper 48 is inserted between the drum surface 26 and forming roller 30 as shown. The cigarette paper 48 has a narrow strip if water soluble glue 50 which is located on the trailing edge of the paper facing the forming roller. The drum is rotated further in the clockwise direction wrapping the cigarette paper 48 about the roll. While the paper still protruded, as shown in FIG. 5, the narrow strip if water soluble glue 50 is wet with a damp brush or sponge. Rolling continues until the finished rolled cigarette 52 drops into the removal channel 24 as shown in FIG. 6. The finished cigarette is then removed and the knob 44 rotated clockwise to return drum 20 to the start position.

Figure 7:
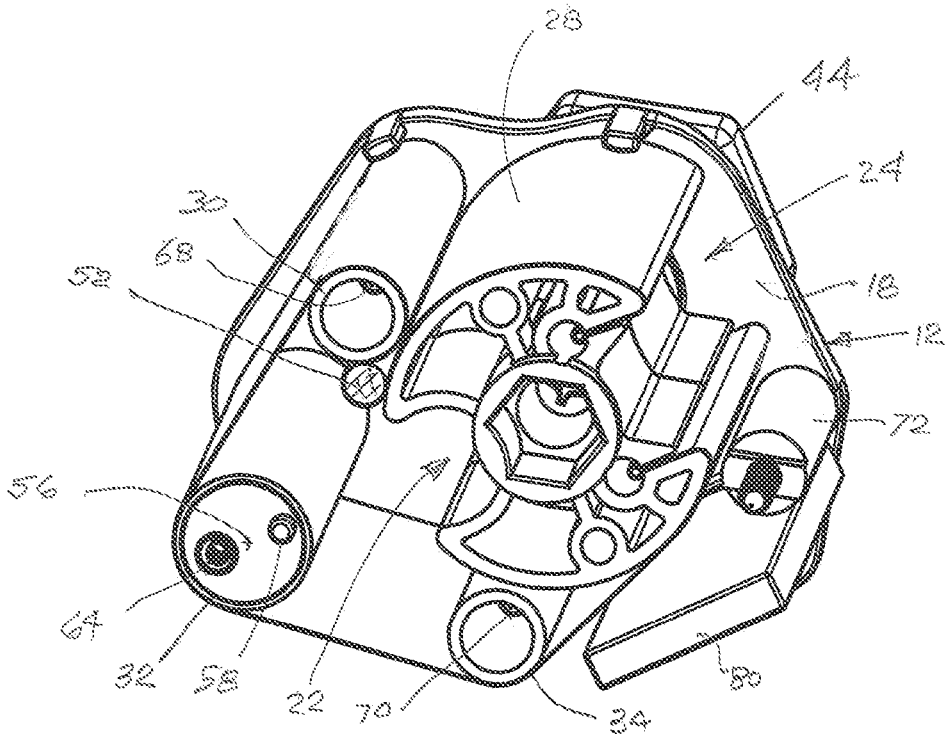
FIG. 7 is a cutaway view of the cigarette rolling machine showing the tension roller mounted on the tension adjuster eccentric shaft in a small diameter roll position.
Figure 8:
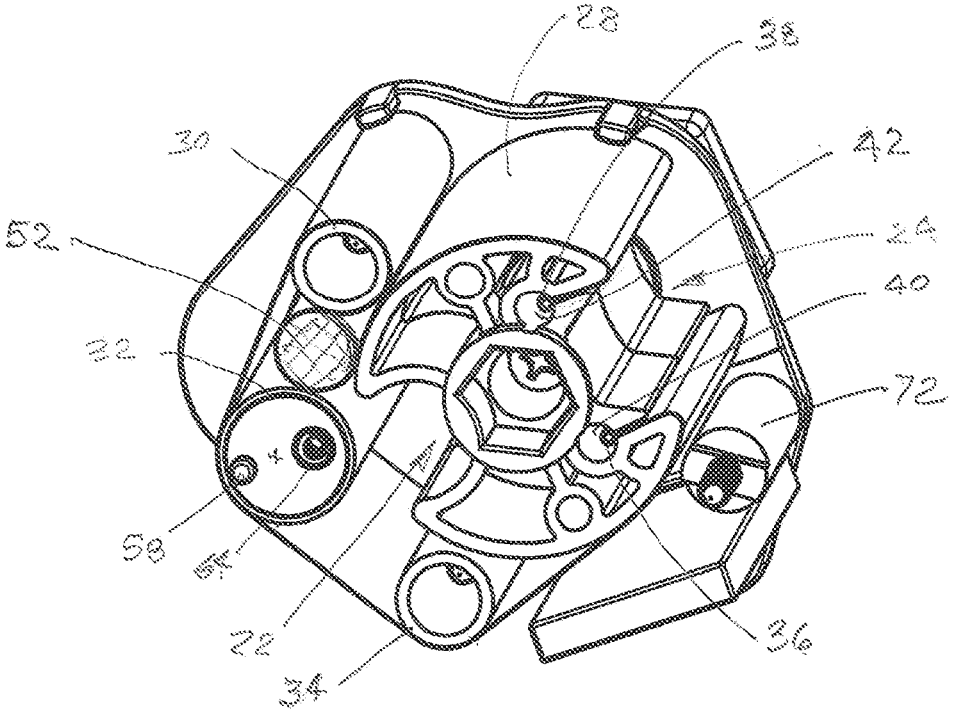
FIG. 8 is a cutaway view of the of the cigarette rolling machine showing the tension roller mounted on the tension adjuster eccentric shaft positioned in a large diameter roll position.
Figure 9:
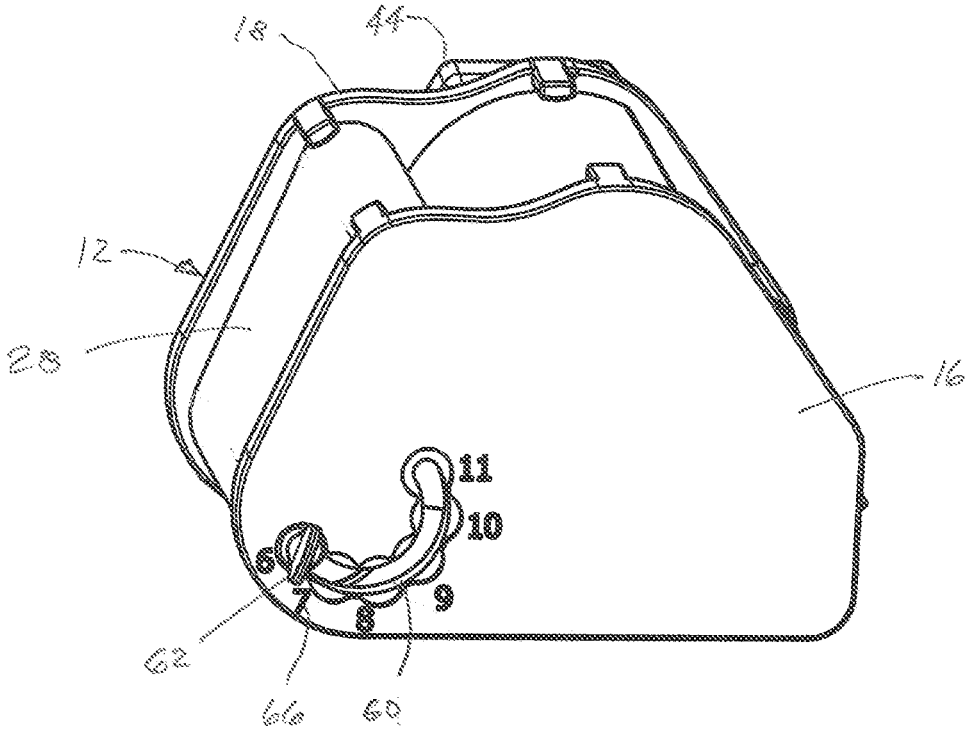
FIG. 9 is a rear side view of the upright side wall showing the eccentric tension roll adjustment slot and lock screw.

The tension roller 32 is shown in FIGS. 7 and 8 adjusted in the minimum and maximum roll diameter positions respectively. Tension roller 32 is a thin tubular sleeve rotatably supported on an eccentrically mounted tension roller support shaft 54. The tension roller support shaft 54 has a central axis 56 coaxial with the tubular tension roller 32 and an offset eccentric axis 58 defined by pivot pins pivotably affixable to pockets (not shown) in the upright side walls 16 and 18. As shown in FIG. 9 the rear upright side wall 16 is provided with an adjustment slot 60 through which lock screw 62 can past to affix to the tension roller support shaft 54 at a point 64, shown in FIGS. 7 and 8, spaced from the offset eccentric axis 58. With the lock screw 62 loose the tension roller support shaft can be moved within the limits of the adjustment slot 60. In the illustrated embodiment the upright side wall 16 is provided with indicia 66 indicating the diameter of the cigarette to be formed, 6 to 11 mm. Preferable recessed pockets adjacent each indicia locate a stepped shoulder, not shown, on the screw in position. The lock screw 62 shown has a wingnut type head to be grasped by the user however other types of knobs of screw head can be used.

The forming roller 30 and idler roller 34 are also tubular and freely mounted on support shafts 68 and 70 extending between the upright side walls 16 and 18. Preferably forming roller 30 and idler roller 34 are formed of a compressible sponge like material. This compressibility enables the diameter of roll to be formed to vary slightly if the amount of tobacco loaded. This minimizes the variations of forces applied to the product during the rolling process preventing a loose or overtight roll. A third support shaft 72 extends between the upright side walls 16 and 18 to provide structural rigidity to the frame 12.

The tension of the belt exerted in the roll of tobacco as it is being rolled is controlled by the amount of tobacco loaded, the location of the tension roller 32, compressibility of the forming roller 30 and idler roller 34, and the contour of the drum surface 26. The drum surface adjacent the forming roller is the rolling surface 74. The diametrically opposed drum surface is the tensioning surface 76. The rolling surface 74 remaining adjenct the forming roller during the forming operation. Preferably the rolling surface 74 and tensioning surface 76 of the drum 20 each extend at least 90 degrees but less 130 degrees of the drum circumference. The tensioning surface 76 acts as a platen on which the cigarette is rolled while the tensioning surface 76 acts a as cam supporting the belt to control the belt tension during the rolling operation.

In the preferred embodiment the drum has a diameter of 1.3 to 2.0 inches. The hopper channel 22 and the removal channel 24 are substantially diametrically opposed on the surface of the drum surface 26. The hopper channel and the removal channel each have a length which is between 90 to 130 degrees of the drum circumference. The hopper channel and the removal channel each have a depth of 40 to 70% of the maximum drum radius, preferably 0.4 to 0.7 inches.

Figure 10:
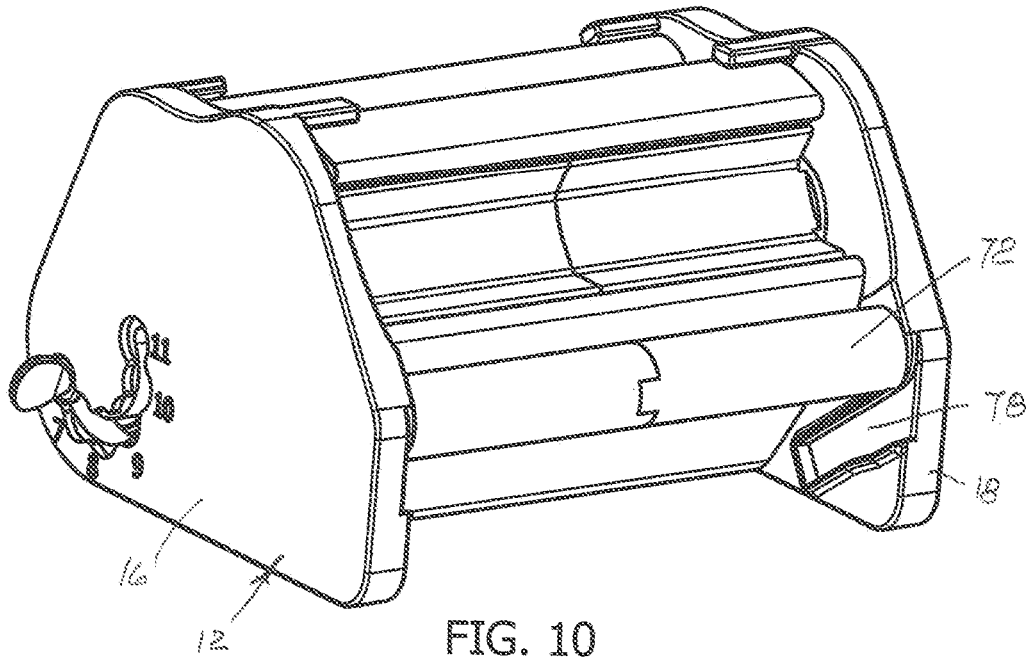
FIG. 10 is an enlarged a perspective view end view showing the slot for receiving and storing a carton of rolling paper.

The preferred cigarette rolling machine has a frame provided with a slot 78 on each side wall sized to receive a carton of rolling paper 80 there between. The slot is shown in FIG. 10. The location of a carton of cigarette papers stored in the slot is shown FIGS. 7 and 8 below the third support shaft 72.

The belt 28 has two ends 36 and 38 attached to spaced apart sides 40, 42 of the removal channel 24. The belt removal channel 24 has at least three and preferably four mounting points for the ends of the belt, two on each side of the removal channel, so that the attachment points can be moved to vary the range of to vary the range of diameters of a cigarette to be formed when the belt tension adjuster is moved. The belt ends 36 and 38 form an enlarged rib size to be received in keyhole shaped slots molded into the wall of the removal channel as shown in FIGS. 7 and 8. The belt is attached to the drum when the machine is being assembled. This is not an adjustment made by the user during normal use of the machine.

Figure 11:
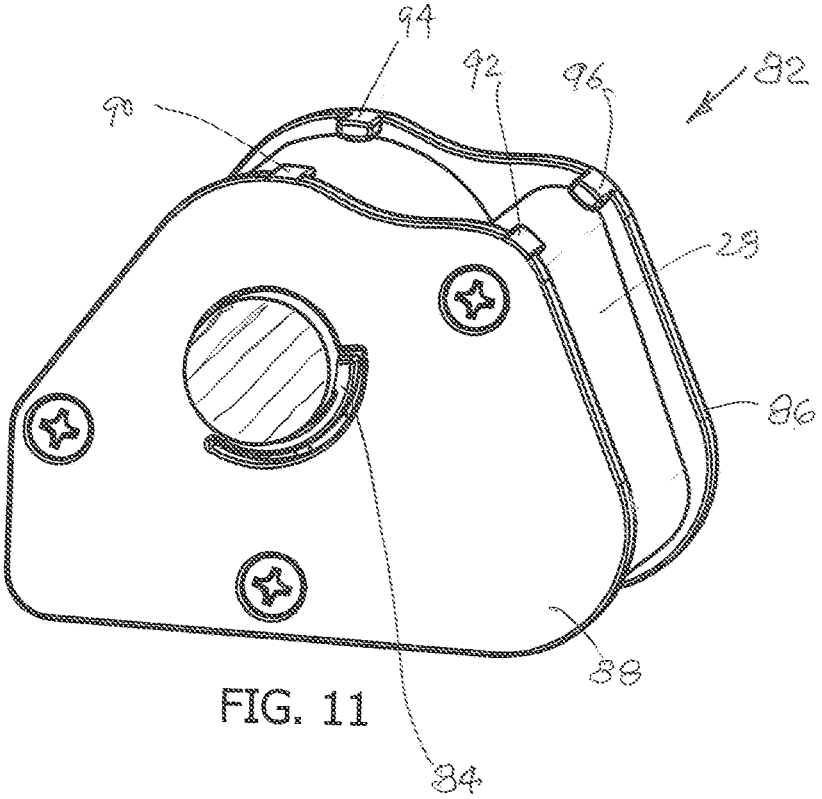
FIG. 11 is a partial cutaway view of the front side view of an alternative embodiment with the knob removed to illustrate a shaft tensioner.

FIG. 11 shows a partial cutaway view of the front side view of an alternative cigarette rolling machine embodiment 82 with the knob removed to illustrate a shaft tensioner 84.

The shaft tensioner 84 is an inwardly radially biased arm which is integrally molded into side wall 86. This feature resists shaft rotation helping the belt stay in position while placing the tobacco into the grove formed by the elongate belt 28 recessed into the hopper channel 22 at the start of the rolling process. Side walls 86 and 88 are provided with short retaining fingers 90, 92, 94 and 96 adjacent the forming roller and the drum which project over the side edges of the belt to keep the belt in place when depressed into the hopper channel.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A portable handheld cigarette rolling machine comprising:

a frame having a bottom adapted to rest on a generally flat surface and a pair of horizontally spaced apart side walls, the side walls sized to be simultaneously gripped by one hand of a user of the machine;

an elongate drum horizontally pivotably supported between the side walls for rotation about a drum axis, the drum having a hopper channel and a circumferentially spaced apart removal channel each formed in a surface of the drum parallel to the axis;

a forming roller pivotably supported between the side walls for rotation about a forming roller axis parallel to the drum axis, the forming roller have a cylindrical surface adjacent to and spaced from the surface of the drum;

an idler roller pivotably supported between the side walls for rotation about an idler roller axis parallel to the drum axis;

an elongate belt having a width sized to fit between and substantially fill the space between the side walls and a length forming a loop extending about the forming roller and the idler roller, the belt having two ends attached to spaced apart sides of the removal channel; and a tensioner roller horizontally pivotably supported between the side walls for rotation about a tensioner axis parallel to the drum axis;

a belt tension adjuster cooperating with the tensioner roller and the frame to move and releasably affix the tensioner roller tensioner axis at a plurality of positions relative to the belt, the belt tension adjuster capable of varying the diameter of a cigarette to be formed; and a knob handle axially connected to one end of the drum and extending outside of the space between the side walls to be gripped by the other hand of a user of the machine;

wherein the tension roller compresses a tubular sleeve rotatably supported on an eccentrically mounted tension roller support shaft releasably affixable to the frame at various positions to vary belt tension; and wherein the side wall adjacent to the handle is provided with an arcuate slot therethrough extending about the eccentric axis of the tension roller and the machine is further comprised of a fastener extending through the arcuate slot which can be operated by a user to lock the tension roller in position in order to vary cigarette diameter.

2. The machine of claim 1, wherein belt tension adjuster comprises an eccentric shaft extending through the tensioner roller and releasably affixable to the side walls at discrete locations offset from the tensioner axis.

3. The machine of claim 1, wherein the knob handle extends axially through and is pivotably supported on one of the side walls.

4. The machine of claim 3, wherein the circumference of the knob to be gripped by the user is provided with a recess feature aligned with the hopper channel to provide drum location information to a user of the machine.

5. The machine of claim 1, wherein the belt loop surrounds the forming roller, the idler roller, the tensioner roller and a substantial portion of the circumference of the drum.

6. The machine of claim 1, wherein the surface of the drum between the hopper channel and the circumferentially spaced apart removal channel which is adjacent the forming roller has a sustainably constant radius.

7. The machine of claim 6, wherein a sustainably constant radius surface of the drum between the hopper channel and the removal channel adjacent the forming roller creates a rolling surface which extends over 90 degrees but less than 130 degrees about the drum circumference.

8. The machine of claim 1, wherein the surface of the drum between the hopper channel and the circumferentially spaced apart removal channel which is not adjacent the forming roller has a sustainably constant radius which engages the belt and maintains belt tension while the cigarette is being formed.

9. The machine of claim 1, wherein the forming roller has a sponge layer on its periphery providing radial elasticity.

10. The machine of claim 1, wherein the idler roller has a sponge on its periphery providing radial elasticity.

11. The machine of claim 1, wherein the drum has a diameter of 1.3 to 2.0 inches.

12. The machine of claim 1, wherein the hopper channel and the removal channel are substantially diametrically opposed on the surface of the drum.

13. The machine of claim 1, wherein the hopper channel and the removal channel each have a width which is between 90 to 130 degrees of the drum circumference.

14. The machine of claim 1, wherein the hopper channel and the removal channel each have a depth of 40 to 70% of the maximum radius of the drum.

15. The machine of claim 1, wherein the frame is provided with a slot on each side wall sized to receive a carton of rolling paper therebetween.

16. The machine of claim 1, wherein the belt has an elongate rib formed on each end for releasably attaching to mounting points formed by grooves in the walls of the removal channel.

17. A portable handheld cigarette rolling machine comprising:

a frame having a bottom adapted to rest on a generally flat surface and a pair of horizontally spaced apart side walls, the side walls sized to be simultaneously gripped by one hand of a user of the machine;

an elongate drum horizontally pivotably supported between the side walls for rotation about a drum axis, the drum having a hopper channel and a circumferentially spaced apart removal channel each formed in a surface of the drum parallel to the drum axis, wherein one the circumferential surfaces of the drum between the hopper channel and a circumferentially spaced apart removal channel forms a rolling surface while an opposed circumferential surface of the drum forms a tensioning surface to maintain belt tension during rolling of the cigarette;

a forming roller pivotably supported between the side walls for rotation about a forming roller axis parallel to the drum axis, the forming roller have a cylindrical surface adjacent to and spaced from the rolling surface of the drum;

an idler roller pivotably supported between the side walls for rotation about an idler roller axis parallel to the drum axis;

an elongate belt having a width sized to fit between and substantially fill the space between the side walls and a length forming a loop extending about the forming roller and the idler roller, the belt having two ends attached to spaced apart sides of the removal channel; and a tensioner roller horizontally pivotably supported between the side walls for rotation about a tensioner axis parallel to the drum axis; and a belt tension adjuster cooperating with the tensioner roller and the frame to move and releasably affix the tensioner roller tensioner axis at a plurality of positions relative to the frame, movement of the belt tensioner roller axis being capable of varying the diameter of a cigarette to be formed; and a knob handle axially connected to one end of the drum and extending outside of the space between the side walls to be gripped by a user of the machine;

wherein the circumference of the knob handle is provided with a recess feature aligned with the hopper channel to provide drum location information to a user of the machine; and wherein the side wall adjacent to the handle is provided with an arcuate slot therethrough extending eccentrically about the axis of the tension roller and the machine is further comprised of a fastener extending through the arcuate slot which can be operated by a user to lock the tension roller in position in order to vary cigarette diameter.

18. The machine of claim 17, wherein the rolling surface and the tensioning surface each have a sustainably constant radius which extends over 90 degrees but less 130 degrees about the drum circumference.

* * * * *